United States Patent [19]

Holahan et al.

[11] 4,322,909

[45] Apr. 6, 1982

[54] TOY FOOD PROCESSOR

[75] Inventors: Edward T. Holahan, Chicago; Burton C. Meyer, Downers Grove, both of Ill.

[73] Assignee: Marvin Glass & Associates, Chicago, Ill.

[21] Appl. No.: 199,006

[22] Filed: Oct. 20, 1980

[51] Int. Cl.[3] ..... A63H 3/52

[52] U.S. Cl. ..... 46/14; 46/17

[58] Field of Search ..... 46/39, 14, 40, 47, 38, 46/1 R, 17, 23, 26; 273/156, 153 R, 153 P

[56] References Cited

U.S. PATENT DOCUMENTS

| | | | |
|---|---|---|---|
| 121,936 | 12/1871 | Fisher | 46/17 |
| 2,882,170 | 4/1959 | Stewart | 426/104 X |
| 3,564,757 | 2/1971 | Fields | 46/17 X |
| 3,828,970 | 8/1974 | Yamamoto | 46/40 X |
| 3,949,658 | 4/1976 | Morrison et al. | 46/39 X |

FOREIGN PATENT DOCUMENTS

| | | | |
|---|---|---|---|
| 1257666 | 12/1977 | United Kingdom | 46/17 |

*Primary Examiner*—Robert Peshock
*Assistant Examiner*—Mickey Yu
*Attorney, Agent, or Firm*—Mason, Kolehmainen, Rathburn & Wyss

[57] ABSTRACT

A toy food processor includes a housing and a bowl in the shape and appearance of a food processor. Various food items are provided which may be removably mounted in an accessible compartment of the bowl. Mounting of a particular food item within the compartment positions the item for slicing by the food processor. A manual crank rotates a cutter blade which successively slices segments from the bottom of the food item and discharges the slices through a chute on the front of the bowl.

12 Claims, 4 Drawing Figures

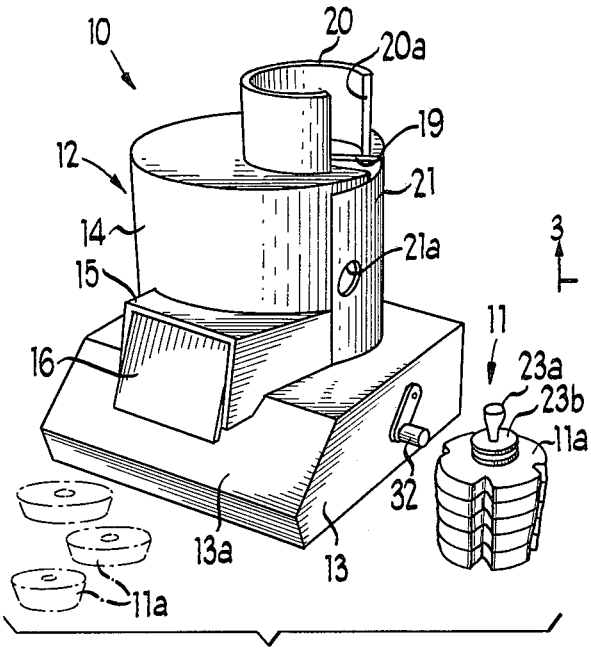
Fig 1
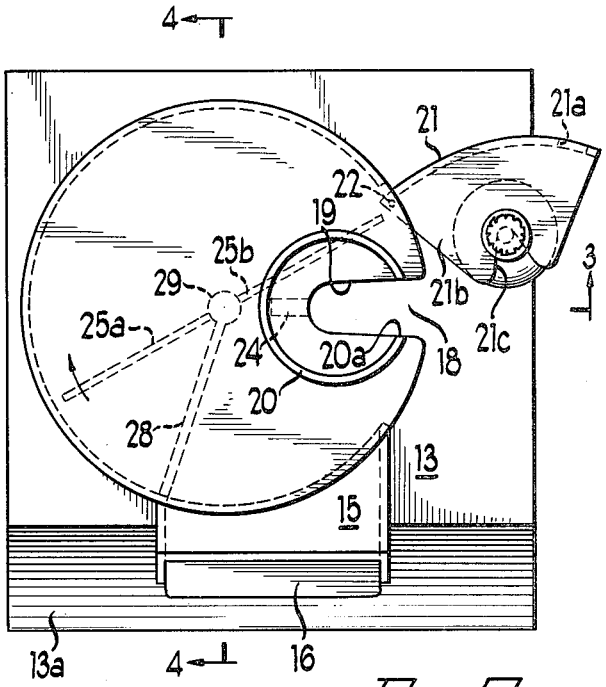
Fig 2
Fig 3
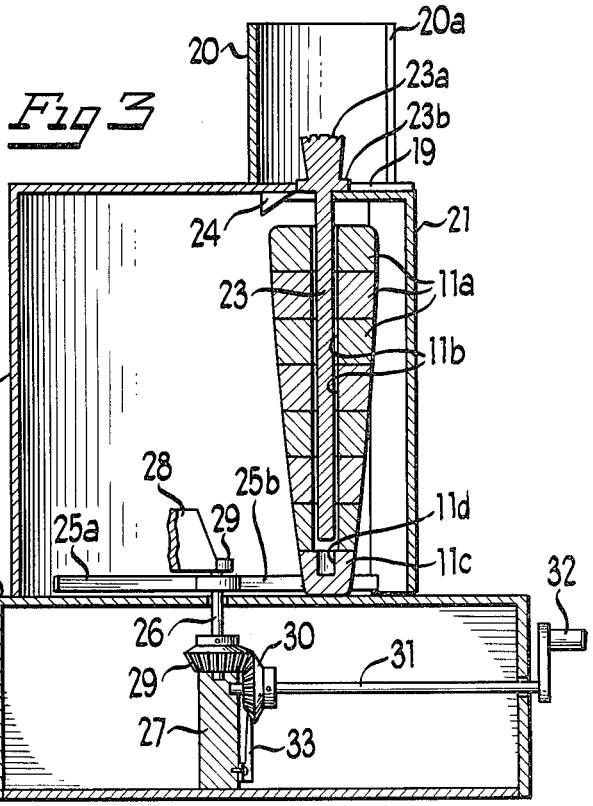
Fig 4
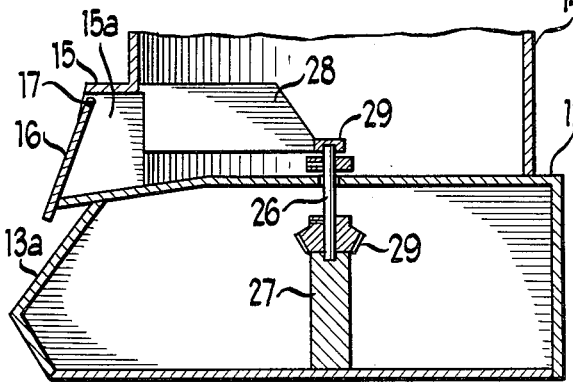

TOY FOOD PROCESSOR

BACKGROUND AND SUMMARY OF THE INVENTION

The present invention relates to toys and more particularly to a toy food processor which may be manually operated to simulate the operation of a conventional food processor in slicing elongated vegetable products, such as carrots and cucumbers, into sliced segments.

It is an object of the invention to provide a toy food processor of the character described which may be easily and safely operated by children.

It is a further object of the invention to provide a toy food processor of the character indicated which is of rugged low cost construction.

It is still another object of the invention to provide for use in a toy food processor of the character described, a single and easily manipulatable food slice module containing a plurality of simulated slices of food product, the slices of which may be readily released and expelled from the toy food processor.

The invention, both as to its organization and method of operation, together with further objects and advantages thereof, will best be understood by reference to the following specification, taken in connection with the accompanying drawings, in which:

BRIEF DESCRIPTION OF THE DRAWINGS

FIG. 1 is a perspective view of the present improved toy food processor with the module of simulated slices of food product disposed alongside the processor;

FIG. 2 is a top plan view of the toy food processor shown in FIG. 1;

FIG. 3 is a sectional view taken along lines 3—3 in FIG. 2; and

FIG. 4 is a sectional view taken along lines 4—4 in FIG. 2.

DESCRIPTION OF THE PREFERRED EMBODIMENT

Referring now to the drawings and more particularly to FIG. 1 thereof, the present improved toy food processor is there shown as comprising a processor 10 and a separable sliced food module 11 which is adapted to be mounted within the processor 10 in the manner more fully explained below. The processor 10 comprises a two-part housing 12 consisting of a lower base housing 13 of substantially square configuration upon which is fixedly mounted a substantially cylindrical closed top upper housing 14. A discharge chute 15, parts of which are formed integrally with the housings 13 and 14, projects outwardly from the side of upper housing 14 and terminates in a discharge opening 15*a* which overlies the downwardly slanting front wall 13*a* of the base housing 13. This discharge opening is normally closed by a small door 16 which is pivotally supported along its upper edge between the sides of the chute 15 by means of a pivot pin 17 and is gravity based to its illustrated closed position.

Along the cylindrical side wall of the housing 14, this wall is provided with a parallel side vertically extending opening 18 therethrough which communicates at its upper end with a slot 19 extending inwardly from the outer edge of the top closure wall of the housing in the manner best shown in FIG. 2 of the drawings. The slot 19 is partially surrounded by an open topped cylindrical member 20 which simulates the food product input hopper of a conventional food processor and is fixedly mounted upon the top wall of the housing 14. As shown, the cylindrical member 20 is provided with a slot 20*a* throughout its height which overlies and is coincident with the slot 19.

For the purpose of closing the opening 18 when the processor 10 is in use, a door 21 is provided which is pivotally mounted on the housing 14 along the edge of the opening 18 by means of a pivot pin 22 and has a finger hole opening 21*a* therethrough to facilitate manual opening and closing of the door. This door functions as a carrier for the food slice module 11. To this end, it is provided at its upper end with a V-shaped laterally extending flange 21*b* which is adapted to underlie the top wall of the housing 14 when the door is closed and is provided with an inwardly extending V-shaped slot 21*c* which is adapted to receive the head end of the holding rod embodied in the module 11 in the manner more fully explained below.

As best shown in FIGS. 1 and 3 of the drawing, the food slice module 11 comprises a plurality of separable simulated food slices 11*a* formed of metal or a plastic material which are arranged in stacked relationship and are provided with aligned centrally disposed openings 11*b* extending therethrough. For the purpose of holding these slices in stacked relationship, a holding rod 23 is provided which extends through the openings 11*b* and the lower end of which is releasably connected to the bottom end slice 11*c* as best shown in FIG. 3 of the drawings. More specifically, the end slide 11*c* is provided with a centrally disposed bore 11*d* which is adapted to form a press fit relationship with the lower end of the rod 23 and thus hold the other slices 11*a* on the rod 23. When the module 11 is disengaged from the dispensing unit, as shown in FIG. 3 of the drawings, the holding rod 23 is equipped with a finger manipulatable knob 23*a* at the upper end thereof the lower end of which terminates in a laterally extending flange 23*b* which is displaced from the top surface of the uppermost slice 11*a*. A cam 24 is securely mounted on the underside of the top wall of the housing 14 to engage the upper edge of the uppermost slice 11*a* as the door 21 is closed and thus break the releasable connection between the lower end slice 11*c* and the lower end of the holding rod 23 in the manner more fully explained below.

In order to dispense the simulated food slices 11*a* from the processor 10, dispensing means are provided which comprises a pair of rotatable dispensing arms 25*a* and 25*b* fixedly mounted upon the upper end of a rotatable shaft 26. This shaft extends through a bearing opening in the top wall of the base housing 13 and is journalled for rotation in an upwardly directed bearing hole formed in the top of a bearing pedestal 27, the pedestal 27 being fixedly mounted on the bottom wall of the housing 13. During rotation, the dispensing arms 25*a* and 25*b* pass freely beneath a slice directing vane 28 which slants inward from the side wall of the housing 14 to the center of this housing in the manner best shown in FIG. 2 of the drawings. At its outer end adjacent the left side of the chute 15 as viewed in FIG. 2, this vane is rigidly connected to the side wall of the housing 14 and at its inner end it carries a bearing part 29 in which the top end of the shaft 26 is journalled.

For the purpose of imparting rotary movement to the shaft 26 and thus to the dispensing arms 25*a* and 25*b*, manually operable drive means are provided which comprises a bevel gear 29 fixedly mounted on the shaft 26, a meshing gear 30, a shaft 31 upon which the gear 30 is fixedly mounted and a manually operable crank 32 fixedly mounted on the outer end of the shaft 31. At its inner end, the shaft 31 is journalled in the bearing pedestal 27 and at its outer end this shaft is supported for rotation in a bearing opening through the side wall of the base housing 13. As will be noted, all moving parts of the processor are disposed within the two housings 13 and 14 thereby to obviate the possibility of small finger entanglement with these parts.

In order to enhance the attractiveness of the described toy processor to children, a noise maker is provided within the base housing 13. This noise maker comprises a leaf spring 33, the fixed end of which is pin mounted on the pedestal 27 and the free end of which is shaped to engage the teeth of the bevel gear 30. More specifically, the free end of the spring 33 is so shaped and positioned as to slide over the teeth of the bevel gear 30 and thus produce a clicking noise during rotation of this gear in one direction and to engage one of the teeth of the gear 30 to prevent rotation of the gear and the connected movable parts in the reverse direction.

The mode of operating the above-described toy food processor should be apparent from the foregoing description. Briefly summarized, however, use of the toy processor is initiated by assembling the simulated food slices 11*a* on the holding rod 23 and tapping the end slice 11*c* onto the end of this rod to complete the module assembly. The module 11 is then hung on the door 21 by inserting the upper end of the rod into the slot 21*c* allowing the knob flange 23*b* to come to rest on the top surface of the door flange 21*b*. With the module in place, the door 21 may be closed. As this door is moved from its open position illustrated in FIG. 2 to its closed position illustrated in FIG. 1, the upper edge of the uppermost simulated food slice 11*a* comes into engagement with the cam 24 and is forced downwardly to effect disengagement of the bottom slice 11*c* from the lower end of the rod 23. This slice 11*c* is thus forced from the holding rod 23 and is held in the path of rotation of the dispensing arms 25*a* and 25*b* by the top wall of the housing 13. The toy processor is now ready to dispense the simulated food slices from the interior of the housing 14.

To this end, the crank 32 is manually operated to rotate the shaft 3 and thus rotate the dispensing arms about the axis of rotation of the shaft 26 in an obvious manner. As the dispensing arms are thus rotated in a clockwise direction as viewed in FIG. 2, the arm 25*b*, for example, engages the side of the end slice 11*c* and sweeps it around the inner surface of the housing 14 over the top wall of the housing 13 until it engages the vane 28. Further rotation of the dispensing arm 25*b* forces the food slice 11*c* down the slope of the vane 28, down the discharge chute 15 and out the mouth of the chute beneath the door 16. As the slice 11*c* is moved from beneath the next uppermost slice by the dispensing arm 25*b*, the next uppermost slice drops down to rest on the top wall of the housing 14 and the remaining slices of the stack drop down a corresponding amount. In this position, the next uppermost slice is picked up by the dispensing arm 25*a* and discharged from the housing 14 in the exact manner just explained by reference to dispensing of the slice 11*c*. Thus, as rotation of the arms 25*a* and 25*b* continues, the slices 11*a* are successively discharged from the housing 14 at the rate of two slices for each complete revolution of the shaft 26. In this connection, it is pointed out that clearance between the lower end of the holding rod 23 and the top wall of the housing 13 is such that only one slice 11*a* can drop free from the lower end of the rod 23 when the underlying slice is removed by one of the dispensing arms 25*a* and 25*b*. It is also pointed out that during rotation of the shaft 31 to effect the above-described slice dispensing operation, the end of the leaf spring 33 cooperates with the teeth of the bevel gear 30 to produce a clicking noise which is pleasing to children. It is also emphasized that reverse rotation of the dispensing arms 25*a* and 25*b* in a counterclockwise direction as viewed in FIG. 2 is prevented through engagement of the end of the spring 33 with one of the teeth of the bevel gear 30.

After all of slices 11*a* have been dispensed from the toy processor in the manner just explained, the door 21 can be opened using the finger hole 21*a* for that purpose, following which the holding rod 23 can be removed from the slot 21*c* and the slices 11*a* reassembled thereon, all in a manner which will be fully apparent from the foregoing explanation.

While the best mode of practicing the invention has been illustrated and described, it will be understood that various modifications may be made in the illustrated embodiment of the invention which are within the true spirit and scope of the invention as defined in the appended claims.

We claim:

1. A toy food processor, comprising simulated slices of a food product, holding means for holding said slices in stacked relationship and dispensing means for expelling a predetermined number of said slices from the toy.

2. A toy food processor as claimed in claim 1, wherein said simulated food product slices are provided with aligned openings therethrough when arranged in stacked relationship, and said holding means comprising a rod extending through said aligned openings.

3. A toy food processor as claimed in claim 2, wherein said slices are retained in stacked relationship on said rod by means of an end slice which is releasably connected to the lower end of said rod.

4. A toy food processor as claimed in any one of claims 1 to 3, inclusive, wherein said dispensing means is operative to expel said slices one at a time from one end of the stack of slices.

5. A toy food processor, comprising a housing having an opening in one side wall thereof, a door movable from an open position to a closed position to close said opening, a separable food slice module comprising a plurality of simulated slices of food product and holding means for releasably holding said slices in stacked relationship in a substantially vertical position, means for detachably supporting said module on said door, release means responsive to closing movement of said door for releasing said slices for gravity pull removal from said holding means, and dispensing means for expelling the released slices from the toy.

6. A toy food processor as claimed in claim 5, wherein said release means comprises a stationary cam mounted on said housing and adapted to be engaged by the upper slice of said module to exert downward pressure on the stacked slices as said door is closed.

7. A toy food processor as claimed in claim 6, wherein said holding means comprises a rod extending through said stacked slices, and wherein the lower end slice of the stacked slice is provided with a releasable press fit connection with the lower end of said rod which is broken in response to the downward pressure exerted on the stacked slices as said door is closed.

8. A toy food processor as claimed in claim 5, wherein said dispensing means is operative to expel the released slices from the toy one at a time.

9. A toy food processor as claimed in claim 7, wherein said housing is provided with a discharge opening through one wall thereof, and wherein said dispensing means comprises a rotatable expulsion arm which sweeps the slices one at a time from beneath the lower end of said rod and expels the swept slice through said discharge opening.

10. A toy food processor as claimed in any one of claims 5 to 9, inclusive, wherein manually operable drive means are provided for operating said dispensing means.

11. For use in a toy food processor, a food slice module comprising a plurality of simulated slices of food product arranged in stacked relationship forming a simulation of a single food product and having aligned openings therethrough, holding means for maintaining said slices in stacked relationship comprising a rod extending through said aligned openings, such that said slices are slidable along said rod, said rod including a finger manipulatable knob fixed permanently at one end thereof, said knob being spaced from its adjacent slice enabling said module to be hung from said knob, said slices including an end slice which is releasably connected to the end of said rod opposite said end including said knob such that displacement of one of said slices relative to said rod results in release of said end slice from said rod.

12. A toy food slice module as claimed in claim 11, wherein the releasable connection between said end slice and the end of said rod is a press fit connection.

* * * * *